US009947276B2

(12) United States Patent
Sato et al.

(10) Patent No.: US 9,947,276 B2
(45) Date of Patent: Apr. 17, 2018

(54) DISPLAY DEVICE, USER TERMINAL, AND METHOD FOR ADJUSTING DISPLAY DEVICE

(71) Applicant: Sharp Kabushiki Kaisha, Osaka-shi, Osaka (JP)

(72) Inventors: Yuichi Sato, Osaka (JP); Kenji Maeda, Osaka (JP); Tatsuo Watanabe, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 416 days.

(21) Appl. No.: 14/785,379

(22) PCT Filed: Apr. 8, 2014

(86) PCT No.: PCT/JP2014/060213
§ 371 (c)(1),
(2) Date: Oct. 19, 2015

(87) PCT Pub. No.: WO2014/175064
PCT Pub. Date: Oct. 30, 2014

(65) Prior Publication Data

US 2016/0086553 A1 Mar. 24, 2016

(30) Foreign Application Priority Data

Apr. 26, 2013 (JP) ..... 2013-094721

(51) Int. Cl.
*G09G 5/10* (2006.01)
*G09G 3/36* (2006.01)

(52) U.S. Cl.
CPC ..... *G09G 3/3607* (2013.01); *G09G 3/3648* (2013.01); *G09G 2320/0242* (2013.01);
(Continued)

(58) Field of Classification Search
CPC .. G09G 3/3607; G09G 3/3618; G09G 3/2003; G06F 1/3265
(Continued)

(56) References Cited

U.S. PATENT DOCUMENTS

2005/0083353 A1 4/2005 Maruyama et al.
2012/0306906 A1* 12/2012 Johnson ..... H04N 1/4072 345/591
(Continued)

FOREIGN PATENT DOCUMENTS

JP 2003-255908 A 9/2003
JP 2005-141190 A 6/2005
(Continued)

OTHER PUBLICATIONS

Official Communication issued in International Patent Application No. PCT/JP2014/060213, dated Jun. 24, 2014.

*Primary Examiner* — Calvin C Ma
(74) *Attorney, Agent, or Firm* — Keating & Bennett, LLP

(57) ABSTRACT

A liquid crystal display device (1) includes an adjustment setting section (11), a color component adjusting section (14), and a background color setting section (12). In a case where the adjustment setting section (11) carries out color component adjustment, (i) the background color setting section (12) carries out a second process of setting a background color and (ii) the color component adjusting section (14) carries out a first process of converting a grayscale level of a picture element. In a case where the adjustment setting section (11) does not carry out the color component adjustment, (i) the background color setting section (12) does not carry out the second process and (ii) the color component adjusting section (14) does not carry out the first process.

18 Claims, 12 Drawing Sheets

(52) U.S. Cl.
CPC ..... *G09G 2320/0252* (2013.01); *G09G 2320/0666* (2013.01); *G09G 2340/14* (2013.01)

(58) Field of Classification Search
USPC ..... 345/591, 593, 690, 87, 213
See application file for complete search history.

(56) References Cited

U.S. PATENT DOCUMENTS

| | | | | |
|---|---|---|---|---|
| 2013/0207993 | A1* | 8/2013 | Vranos ..... | G06T 11/001 345/593 |
| 2014/0022234 | A1 | 1/2014 | Ogawa et al. | |
| 2014/0225940 | A1* | 8/2014 | Nakagawa ..... | G09G 3/3607 345/690 |

FOREIGN PATENT DOCUMENTS

| | | | |
|---|---|---|---|
| JP | 2009-265114 | A | 11/2009 |
| WO | 2013/035594 | A1 | 3/2013 |

* cited by examiner

DISPLAY DEVICE, USER TERMINAL, AND METHOD FOR ADJUSTING DISPLAY DEVICE

TECHNICAL FIELD

The present invention relates to (i) a display device and (ii) a user device including the display device.

BACKGROUND ART

In recent years, thin, light, and low-power-consumption liquid crystal display devices have been remarkably widespread. Typical examples of apparatuses on which to mount such liquid crystal display devices encompass mobile phones, smartphones, notebook-sized PCs (Personal Computers).

Liquid crystal display devices, in some cases, encounter color shift (a phenomenon that an exhibited color differs from a color defined by a video signal) because liquid crystals are slow in response speed.

Patent Literature 1 discloses a display device which generates correction data for overdrive. Overdrive is a technique for alleviating, in a case where display data changes, slowness of a response speed of liquid crystals by temporarily applying, to a pixel, a voltage higher or lower than a target voltage.

Note that according to the technique disclosed in Patent Literature 1, a frame memory is required for comparing (i) display data in a frame before the display data changes with (ii) display data in a frame after the display data changed.

CITATION LIST

Patent Literature

Patent Literature 1

Japanese Patent Application Publication Tokukai No. 2005-141190 (Publication date: Jun. 2, 2005)

SUMMARY OF INVENTION

Technical Problem

Note that a liquid crystal display device is configured so that, in a case where pixels of respective R (Red), G (Green), and B (Blue) color components are supplied with uniform data voltages, a displayed image sometimes does not appear in an achromatic color such as white or gray, but appears colored (e.g. blue). That is, when a grayscale level is set to range from 0 to 255, a white color may not be displayed as is but displayed blue-colored even in a case where the liquid crystal display device displays an image based on display data indicative of white (R=255, G=255, B=255). This is because, even if the R, G and B pixels are supplied with uniform liquid crystal application voltages (data voltages), the display data sometimes does not appear in an achromatic color (white or gray) due to (i) characteristics of the liquid crystal display device or (ii) a difference in emission color of a backlight.

In a case where such a liquid crystal display device carries out color component adjustment so as to cause each of color components (RGB) of uniform grayscale levels to receive a unique data voltage, it is possible to cause the display data indicative of white to be displayed in white (achromatic color).

However, in a case where the color component adjustment is carried out, even the display data indicative of white causes the R, G, and B color components to have differing response speeds because the R, G, and B color components receive differing data voltages. For example, in a case where a data voltage of R is higher than each of data voltages of G and B, a response speed of R alone will become faster. As a result, when a color indicated by display data has been changed from black to white (or an achromatic color), liquid crystals of R pixels respond fast, so that a white color (or an achromatic color) is displayed red-colored. In typical cases, when a white character against a black background has been scrolled, the white character is displayed blurred in red. This phenomenon is herein referred to as a color blur.

According to the above conventional technique, although a respond speed of liquid crystals is increased by overdrive, it is impossible to compensate for differences in response speed among the color components. Accordingly, the above conventional technique cannot solve the above problem of a color blur.

According to an aspect of the present invention, it is possible to realize a display device capable of preventing a color blur from occurring.

Solution to Problem

A display device in accordance with one aspect of the present invention is a display device including picture elements each including a plurality of pixels of respective color components, said display device includes: an adjustment setting section for setting whether or not color component adjustment is to be carried out; a color component adjusting section for selectively carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element; a background color setting section for selectively carrying out, in a case where a character in an achromatic color is displayed against a substantially black background, a second process of setting, as a background color, a color in which the grayscale level of the second color component is higher than the grayscale level of the first color component; and an image generating section for generating, with use of the background color, the input data indicative of a display image, in a case where the color component adjustment is set to be carried out, (i) the background color setting section carrying out the second process and (ii) the color component adjusting section carrying out the first process, and in a case where the color component adjustment is set not to be carried out, (i) the background color setting section not carrying out the second process and (ii) the color component adjusting section not carrying out the first process.

A display device in accordance with one aspect of the present invention is a display device including picture elements each including a plurality of pixels of respective color components, said display device includes: a color component adjusting section for carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element; and a predicting section (21) for predicting an occurrence of a color blur occurring as a result of a change in a display image, in a case where an occurrence of a color blur is predicted, the color component adjusting section not subjecting at least part of the display image to the first process.

A display device adjusting method in accordance with one aspect of the present invention is a method of adjusting a display device, said display device (i) being configured to generate, with use of a set background color, input data indicative of a display image and (ii) including picture elements each including a plurality of pixels of respective color components, said method including: an inspecting step of inspecting whether or not the display device displays a picture element in an achromatic color, the picture element being a picture element in which grayscale levels of respective color components of the input data are equal; a first setting step of setting, in a case where the picture element is determined in the inspecting step to be displayed not in the achromatic color but in a chromatic color which is colored with a second color component, the display device such that the display device carries out a first process of generating output data by making a conversion of a grayscale level of each of pixels of the input data so that the picture element is displayed in the achromatic color, the conversion causing a grayscale level of a second color component of the picture element to be lower than a grayscale level of a first color component of the picture element; and a second setting step of setting, in a case where the display device displays a character in the achromatic color against a substantially black background, the display device such that the display device carries out a second process for setting, as the background color, a color in which the grayscale level of the second color component is higher than the grayscale level of the first color component.

A display device controlling method in accordance with one aspect of the present invention is configured such that a display device to be controlled includes picture elements each including a plurality of pixels of respective color components, said method including: a predicting step of predicting an occurrence of a color blur occurring as a result of a change in a display image; and a color component adjusting step of carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element, in a case where the occurrence of the color blur is predicted, at least part of the display image is not subjected to the first process in the color component adjusting step.

Advantageous Effects of Invention

With one aspect of the present invention, it is possible to display a picture element of an input data in an achromatic color, in which picture element grayscale levels of respective color components are equal. Further, it is also possible to prevent a color blur from occurring to a picture element in an achromatic color.

DESCRIPTION OF EMBODIMENTS

Embodiment 1

One embodiment in accordance with the present invention is discussed in detail below.

(Color Component Adjustment)

First, color component adjustment for adjusting an output balance of a plurality of color components (RGB) is discussed in detail. Note here that a picture element is a unit which includes R, G, and B pixels, so as to represent a color. According to a liquid crystal display device, in a case where pixels of respective R (Red), G (Green), and B (Blue) color components in a picture element are supplied with uniform voltages, the picture element may not appear in an achromatic color such as white or gray, but may appear, for example, blue-colored (in a chromatic color). That is, even though a picture element based on display data indicative of white (R=255, G=255, B=255) is displayed by the liquid crystal display device, the display data may not be displayed in white, but may be displayed blue-colored. In such a case, according to the liquid crystal display device of the present embodiment, color component adjustment is carried out so that the color components (RGB) having uniform grayscale levels are supplied with differing data voltages. Note that a grayscale level is herein assumed to range from 0 to 255.

Figure 2:
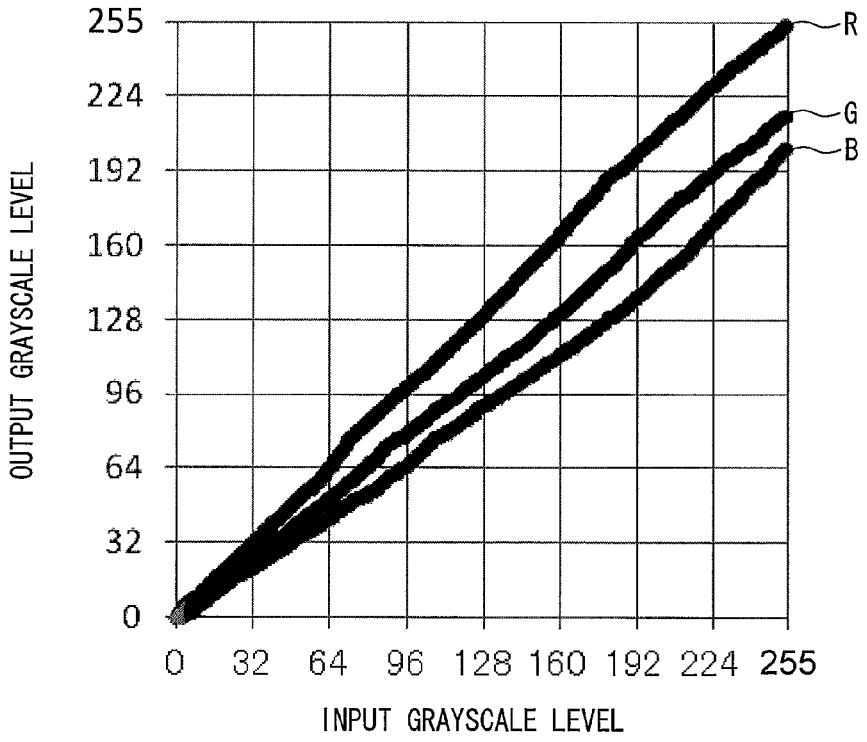
FIG. 2 is a graph illustrating a relationship between input grayscale levels and respective output grayscale levels as a result of color component adjustment.

FIG. 2 is a graph illustrating a relationship between input grayscale levels and respective output grayscale levels as a result of color component adjustment. Digital display data indicative of a grayscale level is herein subjected to a digital grayscale level conversion. The color component adjustment causes a grayscale level conversion of each of the color components in the display data from an input grayscale level into an output grayscale level. A grayscale level conversion of R hardly causes any difference in value between an input grayscale level and an output grayscale level. A grayscale level conversion of G causes an input grayscale level to be converted at a rate lower than that of the grayscale level conversion of R. A grayscale level conversion of B causes an input grayscale level to be converted at a rate even lower than that of the grayscale level conversion of G. As illustrated in FIG. 2, for example, a maximum input grayscale level 255 of R is converted into an output grayscale level 255. Meanwhile, a maximum input grayscale level 255 of G is converted into an output grayscale level of approximately 210, and a maximum input grayscale level 255 of B is converted into an output grayscale level of approximately 200. After the color component adjustment, data voltages corresponding to respective output grayscale levels are generated so as to be supplied to R, G, and B pixels, respectively. A higher output grayscale level results in a greater data voltage to be supplied to a pixel. Since the color component adjustment (grayscale level conversion) is thus carried out, a picture element of display data indicative of white (R=255, G=255, B=255) can be displayed in white (an achromatic color).

Note that, in a case where a picture element of display data indicative of white is displayed red-colored, the color component adjustment is carried out so that a grayscale level conversion causes the output grayscale level of R to be lower than each of the output grayscale levels of G and B.

Figure 3:
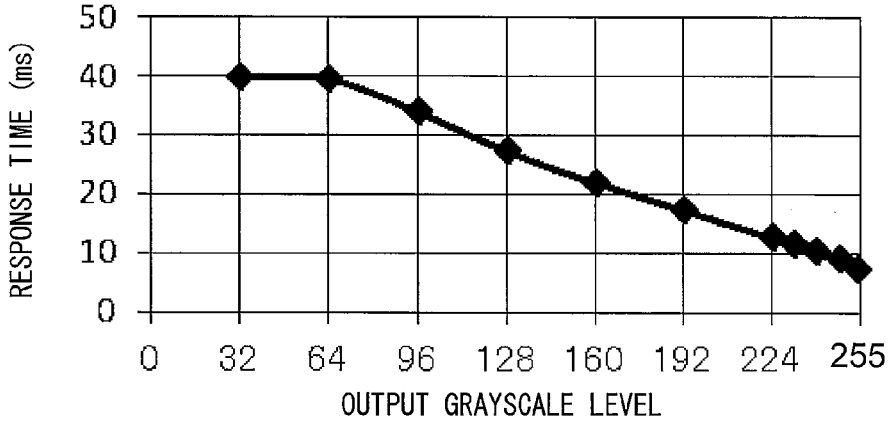
FIG. 3 is a graph illustrating a relationship between an output grayscale level and a response time of liquid crystals.

FIG. 3 is a graph illustrating a relationship between an output grayscale level and a response time of liquid crystals. A unit of the response time is a millisecond. A smaller value of the response time means a faster response (i.e., a response speed is higher). A higher output grayscale level results in a greater data voltage to be supplied to a pixel. As such, a higher output grayscale level results in a faster response speed (see FIG. 3). In a case where color component adjustment is carried out, different data voltages are supplied to respective R, G, and B even if input grayscale levels of the respective pixels are uniform. This causes the color components to have respective response speeds of liquid crystals. In an example shown in FIG. 2, response speeds of respective R, G, and B pixels are in such a relationship as R pixel response speed>G pixel response speed>B pixel response speed.

(Color Blur)

Figure 4:
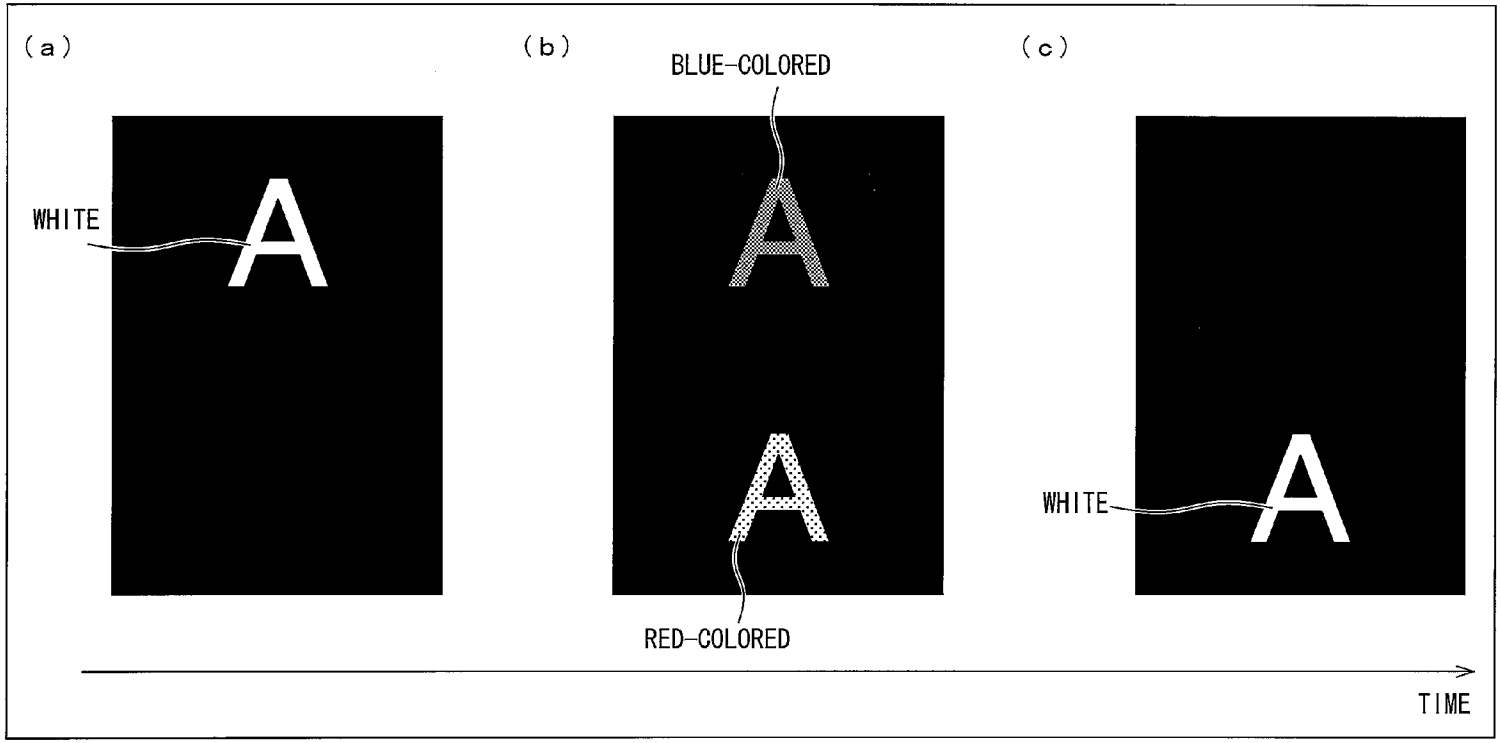
FIG. 4 is a view showing a typical example of a color blur.

FIG. 4 is a view showing, as a typical example of a color blur, how a white character against a black background is scrolled. (b) and (c) of FIG. 4 illustrate, in chronological order, how a white character "A" against a black background illustrated in (a) of FIG. 4 is scrolled downwards. In a screen of (a) of FIG. 4 which illustrates a state before scrolling, the character "A" is displayed in white against the black background. Then, when the character "A" moves downwards by scrolling, the character "A" displayed in a lower part appears red as illustrated in (b) of FIG. 4 since the R pixel is fast in response speed and the B pixel is slow in response speed, and therefore the R pixel responds faster than the B pixel. Meanwhile, in an upper part where the character "A" was originally displayed, the character "A" appears blue since the R pixel is also fast in luminance decreasing speed, and the B pixel is also slow in luminance decreasing speed. When a response of each of the R, G, and B pixels is completed, the character "A" after the scrolling is displayed in white as illustrated in (c) of FIG. 4.

(Measures Against Color Blur)

Note that a response speed of liquid crystals depends on both (i) a data voltage written to a pixel and (ii) a voltage of the pixel before the data voltage is written. That is, the response speed of liquid crystals also depends on an output grayscale level of a frame prior to a frame in which a display image changes.

Figure 5:
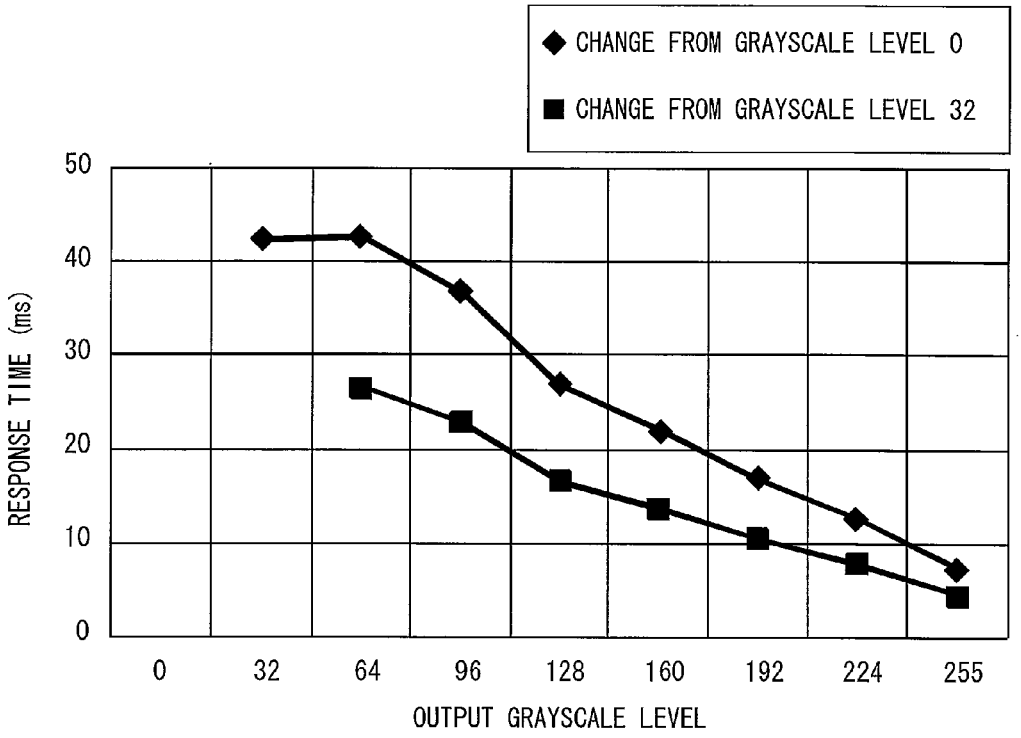
FIG. 5 is a graph illustrating a relationship between output grayscale levels and corresponding response time of liquid crystals.

FIG. 5 is a graph illustrating a relationship between output grayscale levels and corresponding response times of liquid crystals. In FIG. 5, (i) a line with diamond signs represents response times in a case where changes are made from a grayscale level 0 (black color) to a bright grayscale level (output grayscale level) and (ii) a line with square sings represents response times in a case where changes are made from a grayscale level 32 (substantially black) to a bright grayscale level (output grayscale level). A shorter response time means a higher response speed (a faster response of liquid crystals).

FIG. 5 indicates that, in a case where a pixel changes from a dark grayscale level to a bright grayscale level a, a response speed when a change is made from the grayscale level 32 (which has been slightly raised from the grayscale level 0) to the grayscale level a is higher than a response speed when a change is made from the grayscale level 0 to the grayscale level a.

In a case where input grayscale levels of G and B are converted at a rate lower than an input grayscale level of R as illustrated in FIG. 2, response speeds of G and B are lower than a response speed of R. In Embodiment 1, therefore, in a background color, the grayscale levels of G and B have been slightly raised in comparison with the grayscale level of R so that the response speeds of G and B are increased. For example, in a case where a white character is displayed against a black background, a background color is, instead of black with minimum grayscale levels (R=0, G=0, B=0), a substantially black color in which G and B have been raised (R=0, G=10, B=10). This increases the response speeds of G and B pixels, and therefore allows a difference between the response speed of R and the response speeds of G and B to be small. This allows the response speeds of the respective R, G, and B color components to be substantially equal. Therefore, even in a case where a display image changes, it is possible to prevent a color blur of a picture element which should be displayed in an achromatic color.

(Configuration of Liquid Crystal Display Device)

Figure 1:
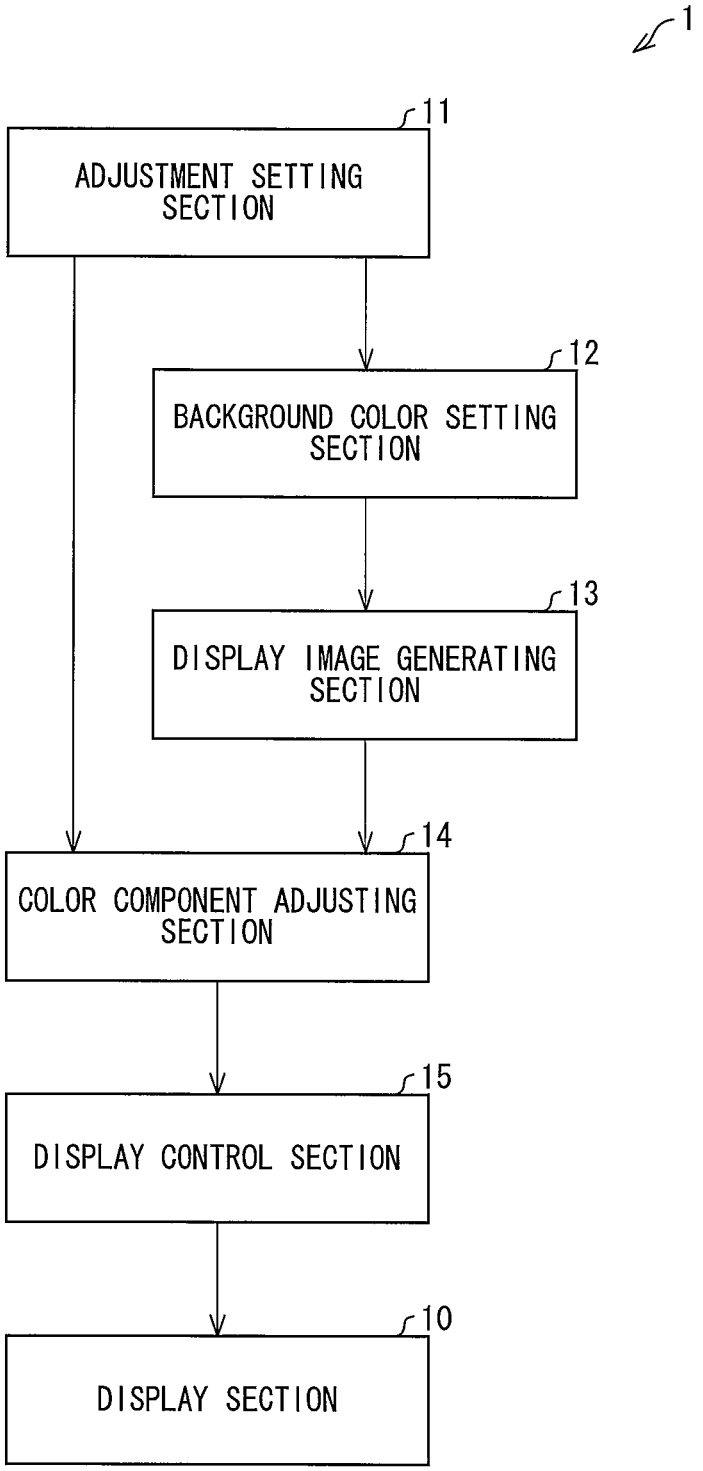
FIG. 1 is a block diagram illustrating a configuration of a liquid crystal display device in accordance with. Embodiment 1 of the present invention.

FIG. 1 is a block diagram illustrating a configuration of a liquid crystal display device 1 of the present embodiment. The liquid crystal display device 1 includes a display section 10, an adjustment setting section 11, a background color setting section 12, a display image generating section 13 (image generating section), a color component adjusting section 14, and a display control section 15.

The liquid crystal display device 1 can be mounted on a user device. Examples of the user device encompass mobile phones, smartphones, notebook-sized PCs, tablet devices, e-book readers, and PDAs. The user device supplies, as a host device, display image data to the liquid crystal display device 1.

The display section 10 includes a screen, and is constituted by, for example, an oxide semiconductor liquid crystal display panel serving as an active matrix liquid crystal display panel. The oxide semiconductor liquid crystal display panel is a liquid crystal display panel in which a semiconductor-TFT is used as each switching element provided so as to correspond to one or more of a plurality of pixels that are two dimensionally arranged. The oxide semiconductor-TFT is a TFT having a semiconductor layer made of an oxide semiconductor. Examples of the oxide semiconductor encompass an oxide semiconductor (In—Ga—Zn—O) in which an oxide of indium, gallium, and zinc is used. According to the oxide semiconductor-TFT, (i) an amount of electric current flowing in an on state is large and (ii) an amount of leak current in an off state is small. Therefore, by using the oxide semiconductor-TFT for a switching element, it is possible to increase a pixel aperture ratio and to reduce a refresh rate of image display to approximately 1 Hz. Reducing the refresh rate allows for such an effect as a reduction in electric power consumption. An increase in a pixel aperture ratio brings about such an effect as causing a displayed image to be brighter. In a case where the brightness of image display is to be set equal to that of a CG (Continuous Grain) silicon liquid crystal display panel or the like, an increased pixel aperture ratio brings about such an effect as reducing electric power consumption by decreasing a light intensity of a backlight.

The adjustment setting section 11 sets, in accordance with an instruction inputted by a user or a manufacturer, whether or not color component adjustment is to be carried out. The adjustment setting section 11 can also set, in accordance with an instruction inputted by a user or a manufacturer, a degree of the color component adjustment (grayscale level conversion rate of each of color components). For example, the adjustment setting section 11 can be configured such that a user or a manufacturer selects one setting value from a plurality of setting values of color component adjustment, which setting values are prepared in advance. The adjustment setting section 11 supplies setting information of the color component adjustment to the background color setting section 12 and to the color component adjusting section 14. The setting information of the color component adjustment includes (i) information indicating whether or not the color component adjustment is to be carried out and (ii) information indicating a degree of the color component adjustment in a case where the color component adjustment is carried out.

The background color setting section 12 sets, in accordance with the setting information of the color component adjustment, a background color and a character color which are used in a specific display image. The specific display image herein means an image, such as a predetermined menu screen, in which a character in an achromatic color is displayed against a substantially black background. For example, in a case where the liquid crystal display device 1 is mounted on a smartphone, the background color setting section 12 can set a background color and a character color in a predetermined menu screen of the smartphone. The background color setting section 12 sets, in the specific display image, (i) the background color to a substantially black color and (ii) the character color to an achromatic color (white or gray).

In a case where (i) the background color is set to the substantially black color and (ii) the color component adjustment is set to be carried out, the background color setting section 12 carries out a process (second process) of setting, as a background color, a color in which a grayscale level c of a second color component is higher than a grayscale level b of a first color component, the second color component having a grayscale level conversion rate smaller than that of the first color component. For example, assume a case in which the color component adjustment is carried out as illustrated in FIG. 2, i.e., a case in which the R, G, and B pixels are in such a relationship as grayscale level conversion rate of R>grayscale level conversion rate of G>grayscale level conversion rate of B. In this case, the background color setting section 12 sets, as the background color, a color in which grayscale levels of G (second color component) and of B are each higher than a grayscale level of R (first color component) in the background color. The background color setting section 12 sets, as the background color, a color in which the grayscale levels of the respective color components are set to be, for example, R=0, G=10, and B=10. Alternatively, the grayscale levels of the respective color components in the background color may be raised according to adjustment amounts of the respective color components in the color component adjustment. For example, grayscale levels in the background color can be set as R<G<B (e.g., R=0, G=10, B=15) in accordance with a relationship of output grayscale levels (R>G>B) of a case where the color components have uniform input grayscale levels. Note that a difference between a minimum grayscale level (R) and a maximum grayscale level (B) in the background color is preferably 20% or less of an entire grayscale level range (0 to 255) so that the background color is prevented from appearing colored. The difference is more preferably 10% or less of the entire grayscale level range. In a case where the maximum grayscale level in the background color is 20% or less of the entire grayscale level range, the background color appears to be substantially black.

Meanwhile, in a case where the color component adjustment is set not to be carried out, the background color setting section 12 does not carry out the process (second process) of causing the grayscale levels of the respective color components to be different from each other in the background color. In this case, the background color setting section 12 sets, as the background color, a color in which the grayscale levels of the respective color components are equal, such as (R=0, G=0, B=0) or (R=5, G=5, B=5).

The background color setting section 12 thus selectively carries out, according to display characteristics of the liquid crystal display device 1, the process (second process) of causing the grayscale levels of the respective color components to be different from each other in the background color. The background color setting section 12 supplies, to the display image generating section 13, the background color and the character color which have been thus set.

The display image generating section 13 generates display data (input data) which indicates a display image to be displayed on the display section 10. In a case where a specific display image such as a menu screen is generated, the display image generating section 13 generates, in accordance with information such as a layout and a character string to be displayed, the display image with use of the background color and the character color designated by the background color setting section 12. The display image generating section 13 supplies, to the color component adjusting section 14, display data indicative the display image thus generated.

The color component adjusting section 14 carries out, in accordance with the setting information of the color component adjustment, color component adjustment of the display image.

In the case where the color component adjustment is set to be carried out, the color component adjusting section 14 carries out a grayscale level conversion of the supplied display data (input data) so that a picture element indicative of an achromatic color in the display data is displayed in an achromatic color. Specifically, the color component adjusting section 14 carries out a process (first process) of generating output data by making a conversion of a grayscale level of each of pixels in the input data. Each of the pixels included in an entire display image is subjected to the first process. The background and the character of the display image are also subjected to the first process. That is, picture elements of any color (pixels with any grayscale level) are subjected to the first process.

On the other hand, in the case where the color component adjustment is set not to be carried out, the color component adjusting section 14 does not carry out the process (first process) of causing each of the color components to have a unique relationship between an input grayscale level and an output grayscale level. In this case, the R, G, and B color components each have such a relationship as input grayscale level=output grayscale level.

The color component adjusting section 14 thus selectively carries out, according to the display characteristics of the liquid crystal display device 1, the process (first process) of causing each of the color components to have a unique relationship between an input grayscale level and an output grayscale level. The color component adjusting section 14 then supplies display data (output data) to the display control section 15.

The display control section 15 generates, in accordance with the display data received, an analog data potential to be supplied to each of the pixels of the display section 10. The display control section 15 supplies, to the display section 10, the data potential thus generated. The display control section 15 further generates a driving signal for driving the display section 10, and supplies the driving signal to the display section 10.

(Process of Adjusting Liquid Crystal Display Device)

Figure 6:
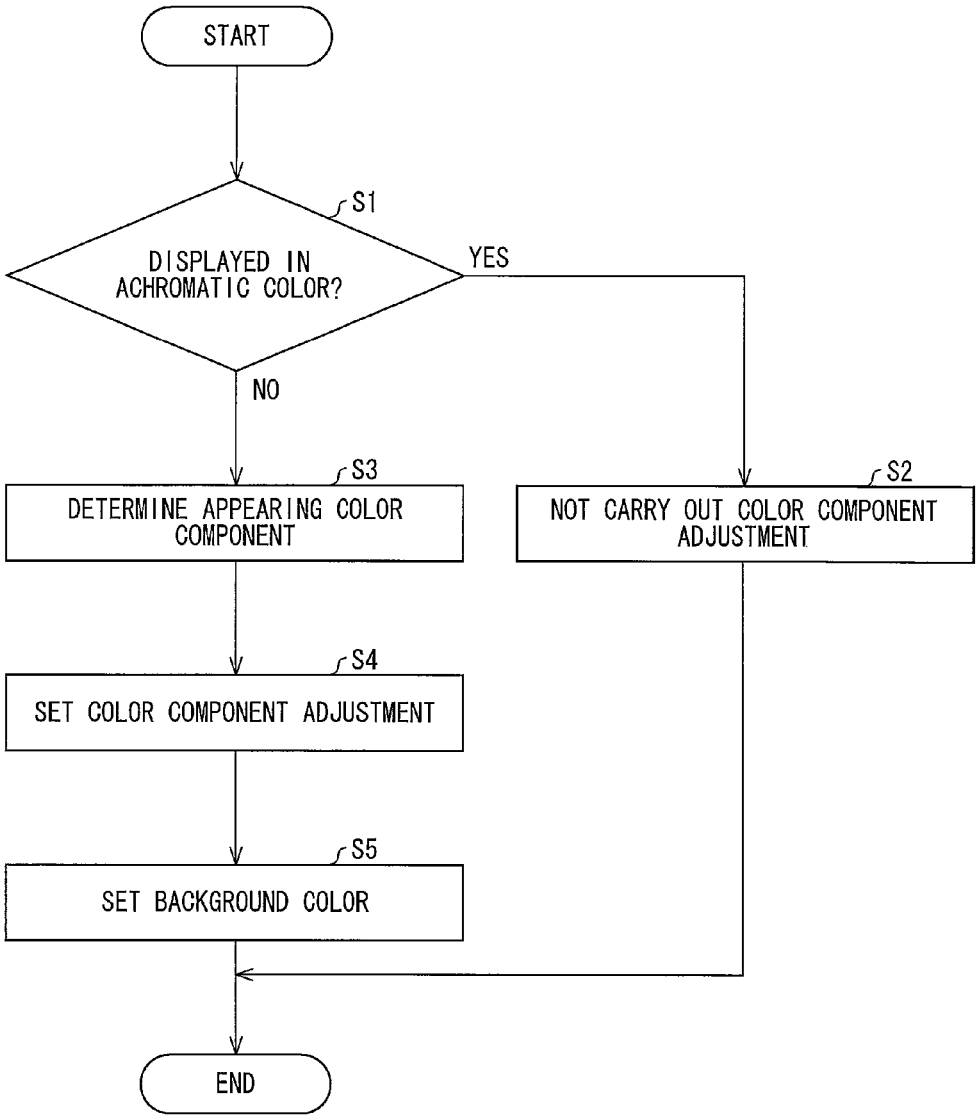
FIG. 6 is a view illustrating a flow chart of a process of adjusting the liquid crystal display device in accordance with Embodiment 1 of the present invention.

FIG. 6 is a view illustrating a flow chart of a process of adjusting the liquid crystal display device 1. Color component adjustment is set in the liquid crystal display device 1 so that an image based on display data indicative of an achromatic color is displayed in an achromatic color. In a case where the color component adjustment is not set, a relationship between an input grayscale level and an output grayscale level is identical across the color components.

First, a user or a manufacturer inspect, under a condition causing the color component adjustment not to be carried out, whether or not an image based on the display data, in which the R, G, and B color components have uniform grayscale levels (the achromatic color is indicated), is to be displayed in an achromatic color by the liquid crystal display device 1 (S1).

In a case where it is judged that the image based on the display data indicative of the achromatic color is to be displayed in an achromatic color (Yes in S1), the user or the manufacturer inputs, in the adjustment setting section 11, an instruction that causes the color component adjustment not to be carried out. In accordance with the instruction, the adjustment setting section 11 sets the color component adjustment not to be carried out (S2). In this case, the R, G, and B color components each have such a relationship as input grayscale level=output grayscale level. Further, the color components of a background color of a specific display image are set to have uniform grayscale levels (e.g., R=0, G=0, B=0).

In a case where it is judged that the image based on the display data indicative of the achromatic color is to be displayed not in an achromatic color but in a chromatic color (No in S1), the user or the manufacturer determines which of the color components appears as the chromatic color (S3). For example, in a case where the image based on the display data indicative of the achromatic color is displayed red-colored, the user or the manufacturer inputs, in the adjustment setting section 11, which of the color components appears as the chromatic color. In a case where the image based on the display data is displayed not in a color of one color component but in a compound color of two color components (G and B) such as light blue, the user or the manufacturer inputs, the adjustment setting section 11, information indicating that the image based on the display data appears colored with the two color components.

In accordance with a color component (second color component) with which the image appears colored, the adjustment setting section 11 sets the color component adjustment so that a rate of an output grayscale level of the second color component becomes smaller than a rate of an output grayscale level of a color component of a complementary color of the second color component (first color component) (S4). Specifically, the adjustment setting section 11 sets a degree of the color component adjustment so that the color component adjusting section 14 carries out the process (first process) of converting input data indicative of an achromatic color into output data in which a grayscale level of the second color component is lower than a grayscale level of the first color component. For example, in a case where an image based on display data indicative of an achromatic color is displayed yellow-colored (a compound color of R and G), the color component adjusting section 14 carries out a grayscale level conversion so that output grayscale levels of R and G are each lower than an output grayscale level of B which is a complementary color. In a case where an image based on display data indicative of the achromatic color is displayed blue-colored (B), the color component adjusting section 14 carries out grayscale level conversions so that the output grayscale level of B is lower than each of the output grayscale levels of R and G which are color components of a complementary color (yellow). This allows an image based on display data indicative of an achromatic color to be displayed in an achromatic color.

In accordance with the color component (second color component) with which the image appears colored, the adjustment setting section 11 sets the background color setting section 12 so that the background color setting section 12 carries out the process (second process) of setting, as a background color, a color in which grayscale levels of the respective color components are different from each other (S5). In this case, the background color setting section 12 sets, in accordance with the color component (second color component) with which the image appears colored, a background color in a specific display image in which a character in an achromatic color is displayed against a black background. Specifically, the background color setting section 12 carries out the process (second process) of setting, as the background color, a color in which a grayscale level of the second color component with which the image appears colored is higher than a grayscale level of a color component (first color component) of a complementary color of the second color component.

(Effect of Liquid Crystal Display Device 1)

Since the first process of subjecting color components to respective grayscale level conversions is thus carried out, an image based on display data indicative of an achromatic color can be displayed in an achromatic color. Further, since the second process of causing the color components in a background color to have different grayscale levels is carried out, it is possible to cause a difference in response speed among the plurality of color components to be small. This makes it possible to prevent a character in an achromatic color from being displayed colored when a display image changes. Note that the present invention can be applied, not only to liquid crystal display devices, but also to display devices in each of which a response speed of a pixel varies depending on a grayscale level of display data.

Note that a user or a manufacturer can not only (i) inputs, in the adjustment setting section 11, a color component with which an image is displayed colored but also (ii) inputs, in the adjustment setting section 11, (a) adjustment amounts by which respective grayscale level of color components are adjusted by grayscale level conversions and (b) an adjustment amount by which a grayscale level of a background color is adjusted. Alternatively, a user or a manufacturer can allow an inspection device, which is equipped with a camera or the like, to automatically carry out operations such as (i) inspecting whether or not an image displayed on the liquid crystal display device 1 is colored, (ii) inputting a color component with which the image is displayed colored, and (iii) inputting an amount by which a grayscale level is to be adjusted.

Alternatively, the adjustment setting section 11 can set an adjustment amount of a grayscale level of a background color in accordance with adjustment amounts of grayscale level conversions, which adjustment amounts are required for color component adjustment. For example, the color component adjusting section 14 converts input data, which is indicative of a white color having maximum grayscale levels (R=255, G=255, B=255), into output data (R=255, G=210, B=200). The background color setting section 12 sets grayscale levels of the respective color components in the background color to R=0, G=10, and B=12. Note that in the output data, the grayscale level of G is lower than the grayscale level of R by 45 (first adjustment amount). In the output data, the grayscale level of B is lower than the grayscale level of R by 55 (first adjustment amount). Further, in the background color, the grayscale level of G is higher than the grayscale level of R by 10 (second adjustment amount). In the background color, the grayscale level of B is higher than the grayscale level of R by 12 (second adjustment amount). The background color setting section 12 thus causes the grayscale levels of the respective color components in the background color to be higher by the second adjustment amounts corresponding to the respective first adjustment amounts. This allows differences in a response speed among the plurality of color components to be even smaller.

Embodiment 2

The following description will discuss another embodiment of the present invention. For convenience, members similar in function to those described in the foregoing embodiment will be given the same reference signs, and their description will be omitted. Embodiment 2 will describe a process of (i) predicting an occurrence of a color blur and (ii) preventing the occurrence of the color blur in a case where the color blur is predicted to occur.

(Configuration of User Device)

Figure 7:
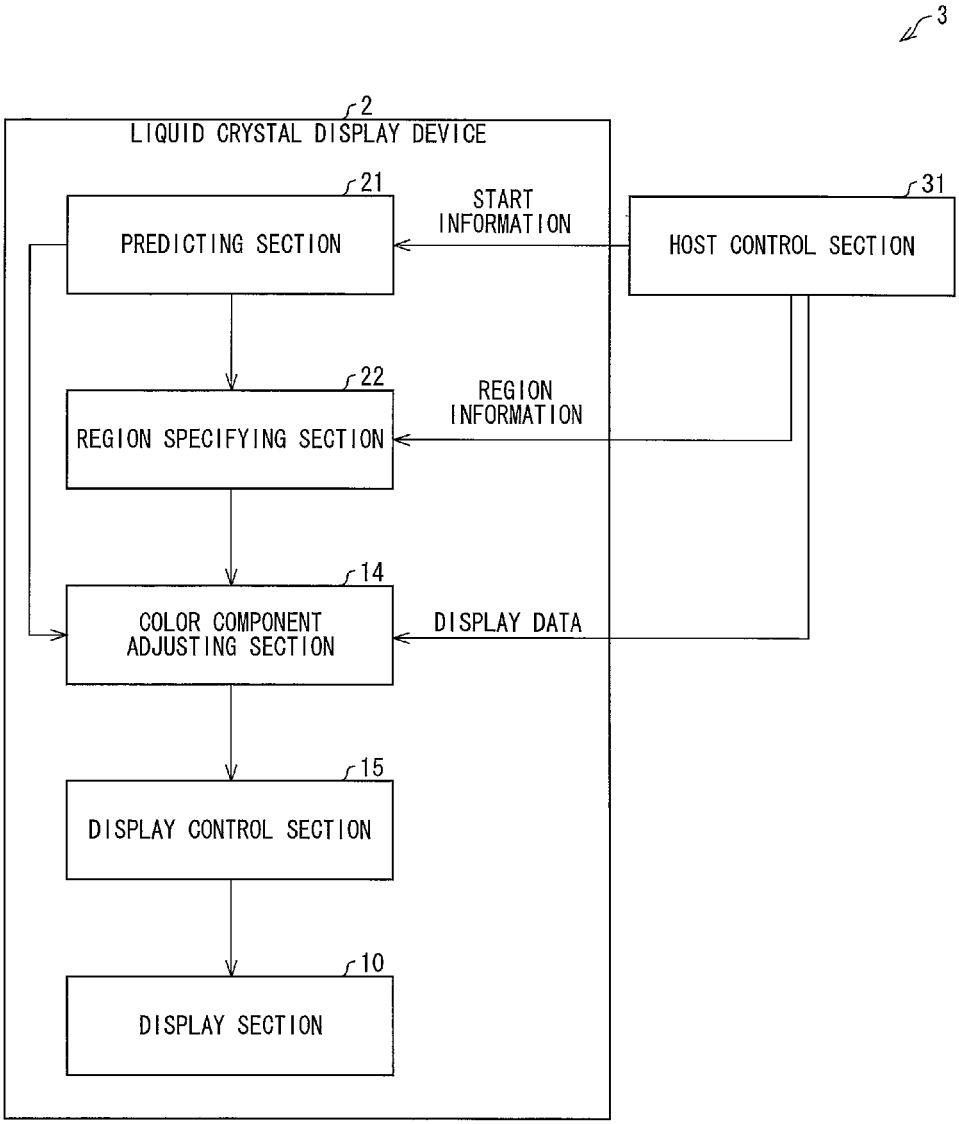
FIG. 7 is a block diagram illustrating a configuration of a user device in accordance with Embodiment 2 of the present invention.

FIG. 7 is a block diagram illustrating a configuration of a user device 3 of Embodiment 2. The user device 3 (host device) includes a host control section 31 and a liquid crystal display device 2. The user device 3 is herein assumed to be a smartphone including a touch panel.

The host control section 31 carries out, as part of the user device 3, processes of executing an application, receiving an input from the touch panel, generating a display image, and the like. The host control section 31 supplies display data indicative of a display image to the liquid crystal display device 2 so that the display image is displayed by the liquid crystal display device 2. Further, the host control section 31 supplies, to the liquid crystal display device 2, start information on a specific application which is likely to cause a color blur. The start information indicates that the specific application is executed (running) in the host control section 31. The host control section 31 supplies, to the liquid crystal display device 2, region information indicating a region (changeable region) of a display image (screen) generated by the specific application, the region corresponding to part of the display image which part may change.

Examples of the specific application which is likely to cause a color blur encompass (i) applications each of which causes the user device 3 to display a setting menu, a list of mail folders, and a list of mails, or a telephone directory and (ii) an application which reproduces a moving image. In a case where a list of items is displayed in character strings as in the above examples, a screen (display image) is often scrolled during use. In a case where the items are displayed in characters in an achromatic color (white or gray) against a black background, a color blur may occur as a result of scrolling. Further, in a case where a moving image is reproduced, a display image continues changing. This may cause an occurrence of a color blur.

Figure 8:
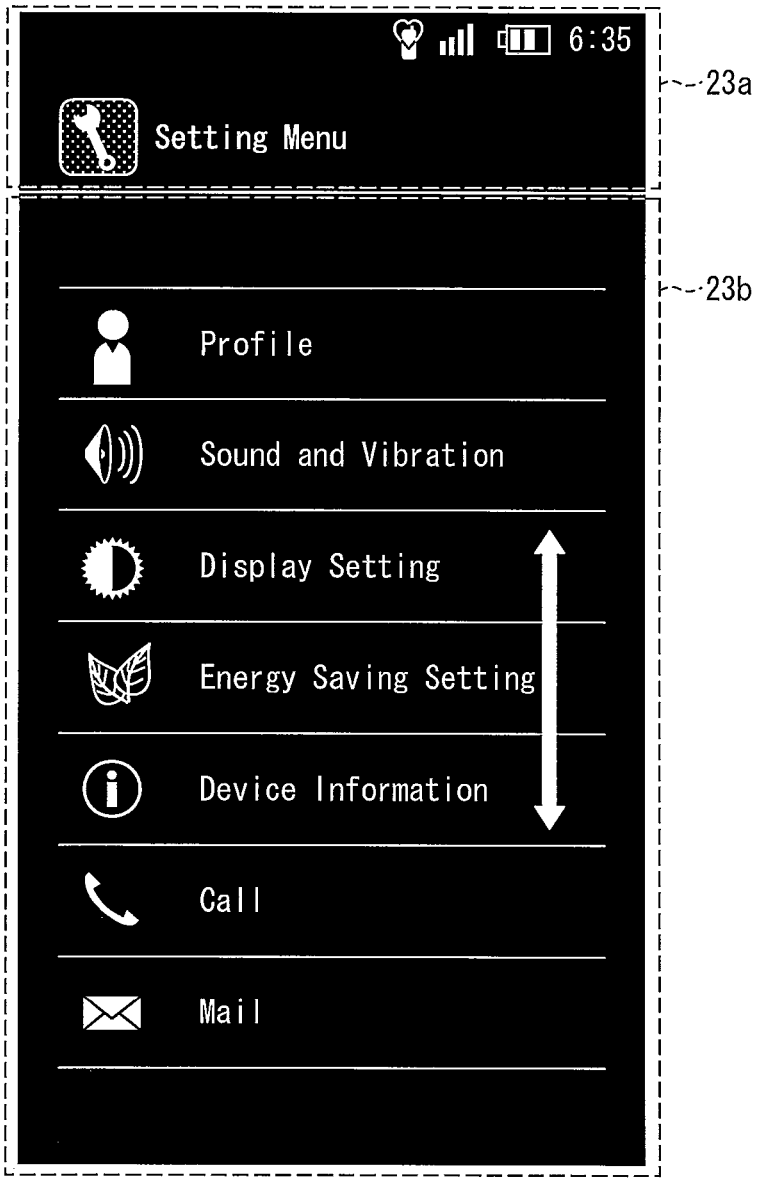
FIG. 8 is a view illustrating a display image (screen) displayed in a case where an application for a setting menu is run.

FIG. 8 is a view illustrating a display image (screen) displayed in a case where an application for the setting menu is run. An upper region 23*a*, in which a title "setting menu" and icons of a remaining battery level and the like are displayed, is unscrollable. A lower region 23*b*, in which a plurality of menus are displayed, is scrollable so that vertically arranged menus are displayed. That is, the region 23*a* is an unchangeable region in which a display image does not change (frequency of changing is expected to be low), whereas the region 23*b* is a changeable region in which a display image changes (frequency of changing is expected to be high). In a case where a plurality of character strings are displayed in characters in an achromatic color (white or gray) against a black background as illustrated in FIG. 8, a color blur may occur in the changeable region 23*b* as a result of scrolling.

Further, it is predicted that, also in a case where a user performs a predetermined operation on an input device such as the touch panel of the user device 3, the display image will change. For example, a user performs a sliding operation on the touch panel so as to scroll the display image. Therefore, the host control section 31 can supply, to the liquid crystal display device 2, operation information indicating whether or not a user is performing an operation on the user device 3.

In Embodiment 2, therefore, color component adjustment is suspended in a case where a color blur is predicted to occur. In a case where a color blur is not predicted to occur, the color component adjustment as illustrated in FIG. 2 is carried out as normal.

(Configuration of Liquid Crystal Display Device)

The liquid crystal display device 2 includes a display section 10, a predicting section 21, a region specifying section 22, a color component adjusting section 14, and a display control section 15. The display section 10 and the display control section 15 are similar in configuration to those in Embodiment 1.

In a case where the predicting section 21 has received the start information from the host control section 31, the predicting section 21 detects that a specific application, which is likely to cause a color blur, is running in the host control section 31. In a case where the specific application is running, the predicting section 21 predicts that a color blur will occur. Then, the predicting section 21 notifies the region specifying section 22 and the color component adjusting section 14 that the color blur is predicted to occur.

The predicting section 21 can receive operation information from the host control section 31. The predicting section 21 can detect, in accordance with the operation information, a change in a display image. In a case where the predicting section 21 has detected the change in the display image, the predicting section 21 predicts that the color blur will occur. Note that it is expected that, when a certain period has passed since a user performed an operation, the display image will cease to change. Accordingly, the predicting section 21 can predict that (i) the color blur will still occur within a predetermined period after a user stops performing the operation and (ii) the color blur will not occur after the predetermined period has passed since the user stopped performing the operation. In a case where the display image changes, the predicting section 21 can receive, from the host control section 31, a display rewriting flag indicating the change in the display image. In accordance with the display rewriting flag, the predicting section 21 can detect the change in the display image. In a case where the host control section 31 supplies display data to the liquid crystal display device 1 only when the display image has changed, the predicting section 21 can detect the change in the display image by the fact that the liquid crystal display device 2 has received the display data.

The region specifying section 22 receives region information from the host control section 31. In the case where the predicting section 21 predicts that the color blur will occur, the region specifying section 22 specifies, in accordance with the region information, a changeable region in which a corresponding part of the display image changes. The region specifying section 22 notifies the color component adjusting section 14 of the changeable region thus specified.

The color component adjusting section 14 receives, from the host control section 31, the display data indicative of the display image. In the case where the predicting section 21 predicts that the color blur will occur, the color component adjusting section 14 subjects an unchangeable region other than the changeable region to a process (first process) of causing each of color components in the inputted display data (input data) to have a unique relationship between an input grayscale level and an output grayscale level. The process of subjecting the color components to respective grayscale level conversions is similar to that in Embodiment 1. In the case where the predicting section 21 predicts that the color blur will occur, the color component adjusting section 14 does not subject the changeable region to the first process. In this case, the R, G, and B color components each have such a relationship as input grayscale level=output grayscale level. The color component adjusting section 14 then supplies display data (output data) to the display control section 15.

Note that in the case where the color blur is not predicted to occur, the color component adjusting section 14 subjects an entire portion of the display image to the process (first process) of causing each of the color components to have a unique relationship between an input grayscale level and an output grayscale level.

(Process of Controlling Liquid Crystal Display Device)

Figure 9:
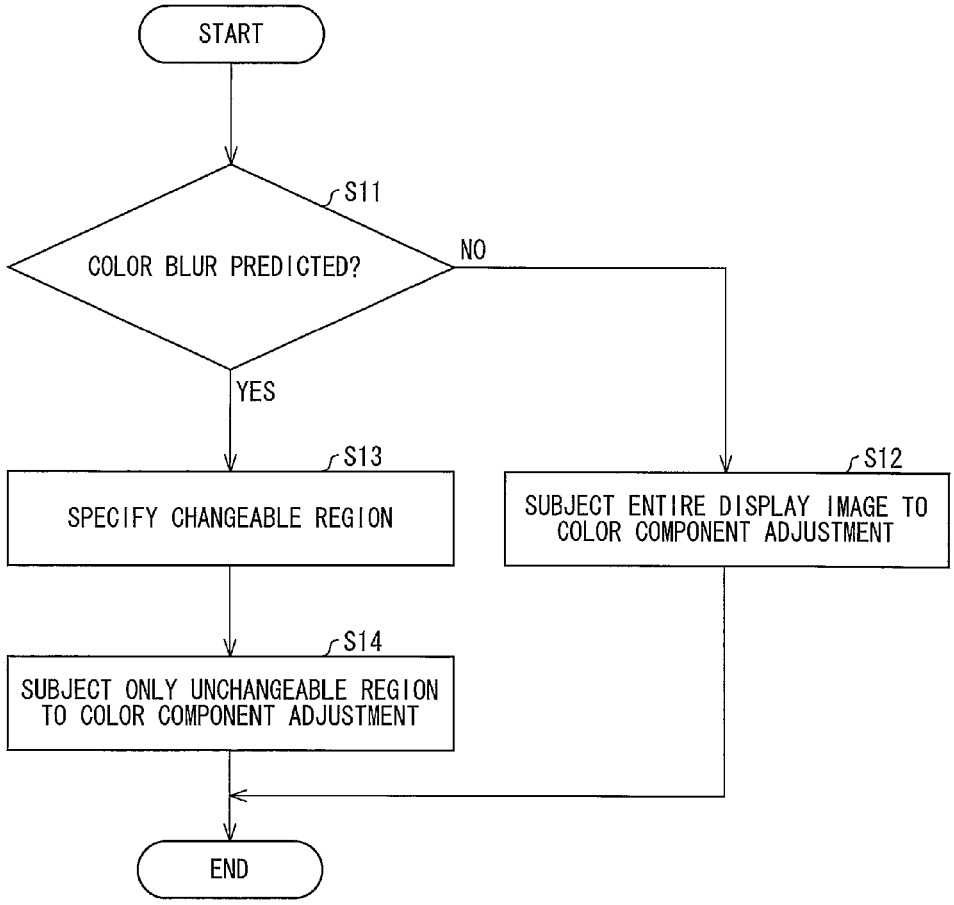
FIG. 9 is a view illustrating a flow of a process of controlling the liquid crystal display device in accordance with Embodiment 2 of the present invention.

FIG. 9 is a view illustrating a flow of a process of controlling the liquid crystal display device 2.

The predicting section 21 determines, in accordance with the start information supplied from the host control section 31, whether or not the specific application is running. In a case where the specific application is running, the predicting section 21 predicts that a color blur will occur (S11). In a case where the specific application is not running, the predicting section 21 does not predict that the color blur will occur.

In a case where the predicting section 21 does not predict that the color blur will occur (No in S11), the color component adjusting section 14 subjects an entire portion of a display image to a process (first process) of causing each of color components to have a unique relationship between an input grayscale level and an output grayscale level (S12).

On the other hand, in a case where the predicting section 21 predicts that the color blur will occur (Yes in S11), the region specifying section 22 specifies a changeable region in which a corresponding part of the display image is expected to change (S13). Then, the color component adjusting section 14 subjects an unchangeable region other than the changeable region in the display image to a process (first process) of causing each of color components to have a unique relationship between an input grayscale level and an output grayscale level. The color component adjusting section 14 does not subject the changeable region to the first process (S14).

(Effect of Liquid Crystal Display Device 2)

In a case where a color blur is predicted to occur, the color component adjusting section 14 thus temporarily does not subject, to color component adjustment (first process), a changeable region in which a corresponding part of a display image changes. Note that, in a case where an entire portion of a display image is predicted to change, such as a case where a moving image is displayed across an entire portion of a screen, it is possible to temporarily not subject the entire portion of the display image to color component adjustment (first process). The color component adjusting section 14 only needs to be configured so that at least part of a display image is not subjected to color component adjustment (first process) in a case where a color blur is predicted to occur.

According to Embodiment 2, the liquid crystal display device 2 (*i*) detects that a specific application, which is likely to cause a color blur, is running and (ii) predict, in accordance with the detection, that the color blur will occur. Alternatively, the liquid crystal display device 2 predicts, in accordance with whether or not a user performs an operation, that the color blur will occur. Then, in a case where the color blur is predicted to occur, the liquid crystal display device 2 temporarily does not subject a changeable region to color component adjustment (first process). This causes the changeable region to be configured such that uniform voltages are supplied to respective R, G, and B pixels of a picture element which receives display data indicative of an achromatic color. This causes the R, G, and B pixels to be identical in response speed. Accordingly, it is possible to prevent a color blur from occurring even in a case where a display image changes. Meanwhile, an unchangeable region is subjected to color component adjustment. This allows a display quality to be maintained. Note that the predicting section 21 thus predicts an occurrence of a color blue in accordance with (i) start information of a specific application, (ii) whether or not a user is performing an operation on the user device 3, or (iii) a display rewriting flag. This makes it unnecessary to compare a display image in a given frame and a display image in a following frame. Therefore, it is not necessary to include a frame memory for predicting an occurrence of a color blur. However, the configuration of the liquid crystal display device 2 is not limited as such. Alternatively, it is possible to (i) include a frame memory and (ii) cause the predicting section 21 to compare, with the use of the frame memory, a display image in a given frame and a display image in a following frame so as to detect a change in a display image.

Embodiment 3

The following description will discuss another embodiment of the present invention. For convenience, members similar in function to those described in the foregoing embodiment(s) will be given the same reference signs, and their description will be omitted. Embodiment 3 will describe predicting an occurrence of a color blur in accordance with a contrast of a display image.

A configuration of a liquid crystal display device of Embodiment 3 is illustrated by a block diagram identical to that illustrated in FIG. 7. Note, however, that a predicting section 21 receives, from a host control section 31, not start information but display data indicative of a display image.

The predicting section 21 generates a histogram in which grayscale levels of respective pixels of the display data are categorized. The predicting section 21 calculates, based on the histogram, a contrast of the display image.

Note that the predicting section 21 can generate a histogram based only on grayscale levels of pixels, regardless of color components. Alternatively, the predicting section 21 can generate a histogram based on average grayscale levels, each of which is of R, G, and B pixels included in a corresponding picture element. Alternatively, the predicting section 21 can generate a histogram, not based on grayscale levels, but based on luminances of respective picture elements, in which histogram the luminances of the respective picture elements are categorized. Luminance Y can be calculated by, for example, use of the following formula:

$$\text{luminance } Y = R\ \text{grayscale} \times 0.29891 + G\ \text{grayscale} \times 0.58661 + B\ \text{grayscale} \times 0.11448.$$

Figure 10:
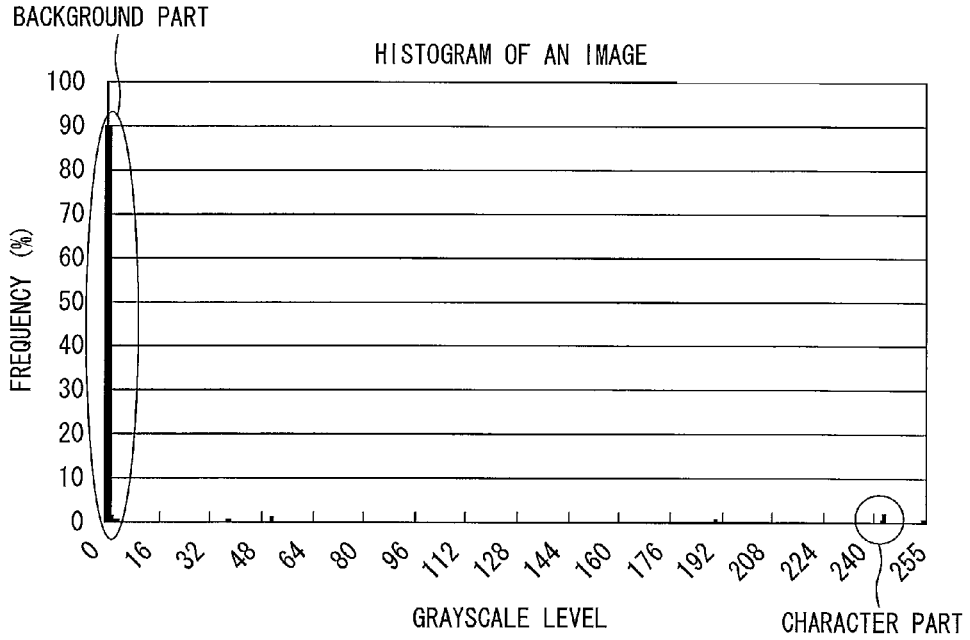
FIG. 10 is a view illustrating a histogram in which grayscale levels of respective pixels in a display image are categorized in Embodiment 3 of the present invention.

FIG. 10 is a view illustrating a histogram in which grayscale levels of respective pixels in a display image are categorized. The histogram corresponds to, for example, a display image in which white characters are displayed against a black background as illustrated in FIG. 8. Therefore, (i) a high peak exists near grayscale level 0 and (ii) a low peak exists near grayscale level 255. The high peak near grayscale level 0 corresponds to pixels in a background part. The low peak near grayscale level 255 corresponds to pixels in character parts. In a case where a peak of a low grayscale level and a peak of a high grayscale level are at some distance as is the case of this histogram, it can be considered that a contrast of a display image is high. In a case where a display image has a high contrast, it can be predicted that the display image is a display image likely to cause a color blur, such as one constituted by a background and characters as illustrated in FIG. 8.

A contrast to be calculated can be, for example, a ratio or a difference between (i) a frequency of grayscale levels lower than a predetermined grayscale level and (ii) a frequency of grayscale levels higher than a predetermined grayscale level. Alternatively, a contrast to be calculated can be a ratio or a difference between grayscale levels of two peaks in a histogram. Note, however, that a contrast can be calculated not only by the above methods but also by a general method for calculating a value representing a contrast.

In a case where the contrast thus calculated is higher than a predetermined reference value, the predicting section 21 predicts that a color blur will occur. For example, in a case where a contrast of a display image is higher than a predetermined first threshold value, the predicting section 21 predicts that a color blur will occur. In a case where the contrast of the display image is equal to or lower than the first threshold value, the predicting section 21 does not predict that the color blur will occur.

Operations of a region specifying section 22 and of a color component adjusting section 14 are similar to those in Embodiment 2. That is, since a color blur is predicted to occur in the case where the contrast of the display image is higher than the predetermined reference value, the color component adjusting section 14 in such a case does not subject a changeable region to color component adjustment. This, in a case where a contrast indicates that a display image is likely to cause a color blur, makes it possible to prevent the color blur from occurring by not subjecting part of the display image to color component adjustment.

Whether or not a contrast is higher than a predetermined reference value can alternatively be determined under a condition where the predetermined reference value has a hysteresis. In such a case, the following is true: In a case where the predicting section 21 does not predict, in a frame (display image) immediately before a current frame, an occurrence of a color blur, the predicting section 21 determines, in accordance with whether or not a contrast is higher than a first threshold value, whether or not the contrast is higher than a predetermined reference value. On the other hand, in a case where the predicting section 21 predicts, in the frame (display image) immediately before the current frame, the occurrence of the color blur, the predicting section 21 determines, in accordance with whether or not the contrast is higher than a second threshold value, whether or not the contrast is higher than the predetermined reference value. The second threshold value is lower than the first threshold value. Since whether a contrast is higher than a predetermined reference value is determined under the condition where the predetermined reference value has a hysteresis, it is possible to prevent a slight change in a display image from causing switching between carrying out and not carrying out color component adjustment.

Embodiment 4

The following description will discuss another embodiment of the present invention. For convenience, members similar in function to those described in the foregoing embodiment(s) will be given the same reference signs, and their description will be omitted. Embodiment 4 will describe preventing an occurrence of a color blur by not subjecting a specific color to color component adjustment.

Figure 11:
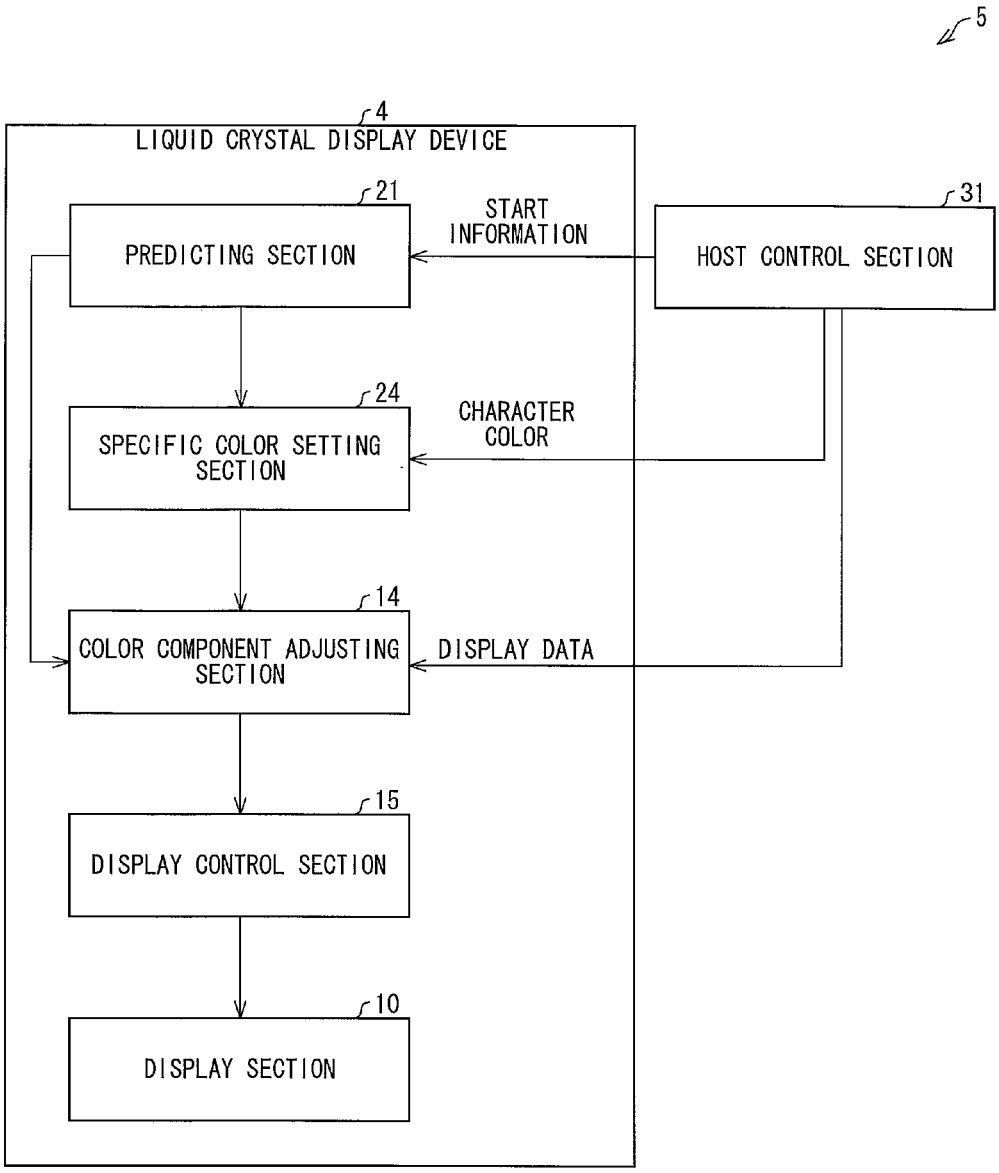
FIG. 11 is a block diagram illustrating a configuration of a user device in accordance with Embodiment 4 of the present invention.

FIG. 11 is a block diagram illustrating a configuration of a user device 5 of Embodiment 4. The user device 5 includes a host control section 31 and a liquid crystal display device 4. The host control section 31 supplies, to the liquid crystal display device 4, (i) start information of a specific application and (ii) character color information indicative of a character color to be used in a display image of the specific application.

The liquid crystal display device 4 includes a display section 10, a predicting section 21, a specific color setting section 24, a color component adjusting section 14, and a display control section 15. The display section 10, the predicting section 21, and the display control section 15 are similar in configuration to those in Embodiment 1. The predicting section 21 notifies the specific color setting section 24 that a color blur is predicted to occur. Note that the predicting section 21 can predict an occurrence of a color blur by use of a method as described in the above embodiment(s).

In accordance with the character color information, the specific color setting section 24 sets, as a specific color, a color which is used as a character color in the display image. The specific color is made by a specific combination of grayscale levels of respective R, G, and B color components. For example, the specific color setting section 24 sets, as a specific color, a color represented by a combination of R=250, G=250, and B=250 (achromatic color). Alternatively, the specific color setting section 24 can set, as a specific color, a color in which grayscale levels of the respective color components slightly differ (e.g. R=250, G=245, B=240). The specific color setting section 24 notifies the color component adjusting section 14 of the specific color.

In a case where the color blur is predicted to occur, the color component adjusting section 14 subjects an entire portion of the display image except a picture element(s) of the specific color to a process (first process) of causing each of the color components to have a unique relationship between an input grayscale level and an output grayscale level. Even in the case where the color blur is predicted to occur, the picture element(s) of the specific color is thus not subjected to the first process. Therefore, since the character color in the display image is not subjected to color component adjustment, a color blur in characters does not occur. On the other hand, an image (e.g., a background) other than the characters is subjected to color component adjustment. This allow a display quality to be maintained.

Note that in a case where a color blur is not predicted to occur, the color component adjusting section 14 subjects the entire display image including the picture element(s) of the specific color to color component adjustment.

Note that the host control section 31 can set, as a character color, a color which is not used as a background color in a display image of a specific application. Alternatively, the specific color setting section 24 can set a character color and a background color, and supply them to the host control section 31. The host control section 31 can generate, by use of the character color and the background color thus specified, a display image of a menu screen as illustrated in FIG. 8. This prevents an occurrence of a color blur.

Further, there can be a plurality of specific colors. In a case where a color blur is predicted to occur, the color component adjusting section 14 (*i*) does not subject picture elements of the plurality of specific colors to the first process and (ii) subjects, to the first process, picture elements of colors other than the plurality of specific colors. This allows characters of respective colors to be used.

Embodiment 5

The following description will discuss another embodiment of the present invention. For convenience, members similar in function to those described in the foregoing embodiment(s) will be given the same reference signs, and their description will be omitted. Embodiment 5 will describe preventing an occurrence of a color blur by not carrying out color component adjustment during a frame period in which a display image changes.

Figure 12:
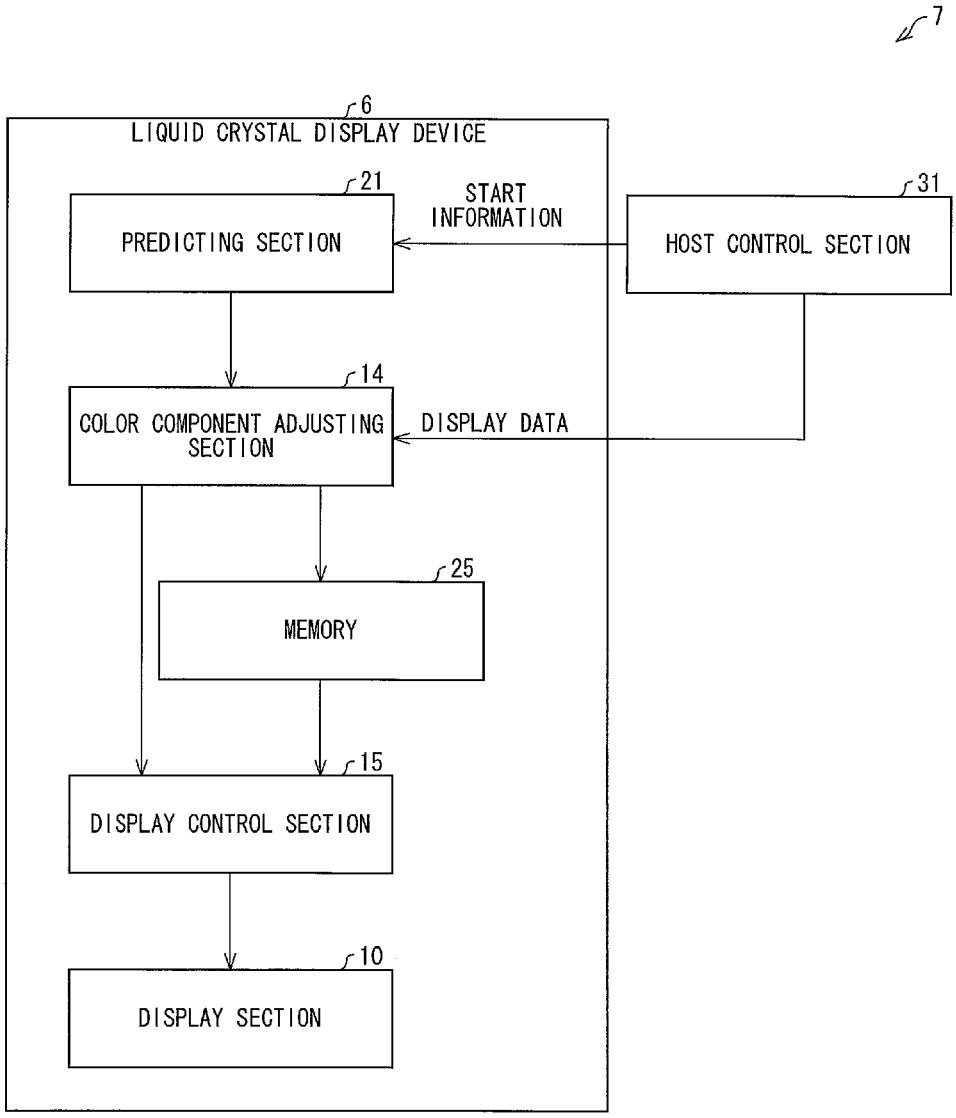
FIG. 12 is a block diagram illustrating a configuration of a user device in accordance with Embodiment 5 of the present invention.

FIG. 12 is block diagram illustrating a configuration of a user device 7 of Embodiment 5. The user device 7 includes a host control section 31 and a liquid crystal display device 6. The host control section 31 supplies display data to the liquid crystal display device 6 only in a case where a display image changes.

The liquid crystal display device 6 includes a display section 10, a predicting section 21, a memory 25, a color component adjusting section 14, and a display control section 15. The display section 10 and the predicting section 21 are similar in configuration to those in Embodiment 1. The predicting section 21 notifies the color component adjusting section 14 that a color blur is predicted to occur. Note that the predicting section 21 can predict an occurrence of a color blur by use of a method as described in the above embodiment(s).

In a case where the color component adjusting section 14 has received the display data from the host control section 31, the color component adjusting section 14 can determine that the display image will change. That is, the color component adjustment 14 does not receive the display data during a frame period in which the display image does not change.

Note that a frame period corresponds to a period required for updating an image in a single frame of the display section 10. For example, in a case where an image can be updated at a refresh rate of 60 Hz, a single frame period corresponds to 1/60 seconds.

In a case where the predicting section 21 predicts an occurrence of a color blur, the color component adjusting section 14 supplies, to the display control section 15, display data in which a process (first process) of causing each of color components to have a unique relationship between an input grayscale level and an output grayscale level has not been carried out. Further, the color component adjusting section 14 subjects an entire portion of the display image to the process (first process) of causing each of the color components to have a unique relationship between an input grayscale level and an output grayscale level. The color component adjusting section 14 then causes the memory 25 to store display data (output data) in which the first process (color component adjustment) has been carried out.

In a case where the predicting section 21 does not predict the occurrence of the color blur, the color component adjusting section 14 subjects the entire portion of the display image to the process (first process) of causing each of the color components to have a unique relationship between an input grayscale level and an output grayscale level. The color component adjusting section 14 then supplies, to the display control section 15 and to the memory 25, the display data (output data) in which the first process (color component adjustment) has been carried out.

The memory 25 stores the display data thus supplied from the color component adjusting section 14. The memory 25 retains the display data until next display data is supplied from the color component adjusting section 14.

During a frame period in which the display image changes, the display control section 15 causes the display section 10 to display the display data which has been supplied from the color component adjusting section 14. In the case where the predicting section 21 predicts the occurrence of the color blur, the display data supplied from the color component adjusting section 14 is display data in which the first process has not been carried out. Specifically, during the frame period in which the display image changes, the display control section 15 generates, in accordance with the display data in which the first process has not been carried out, an analog data potential to be supplied to each pixel of the display section 10. The display control section 15 then supplies, to the display section 10, the data potential thus generated.

Further, for displaying a next frame following the frame in which the display image has changed, the display control section 15 receives, from the memory 25, the display data in which the first process has been carried out. During a frame period (e.g., next frame period) which comes a first interval after the frame period in which the display image has changed, the display control section 15 causes the display section 10 to display the display data in which the first process has been carried out.

Then, until the display image changes, the display control section 15 (*i*) receives, from the memory 25, the display data in which the first process has been carried out and (ii) causes the display section 10 to display, at second intervals each of which is longer than the first interval, the display data in which the first process has been carried out. That is, the display control section 15 refreshes a displayed image at the second intervals.

Figure 13:
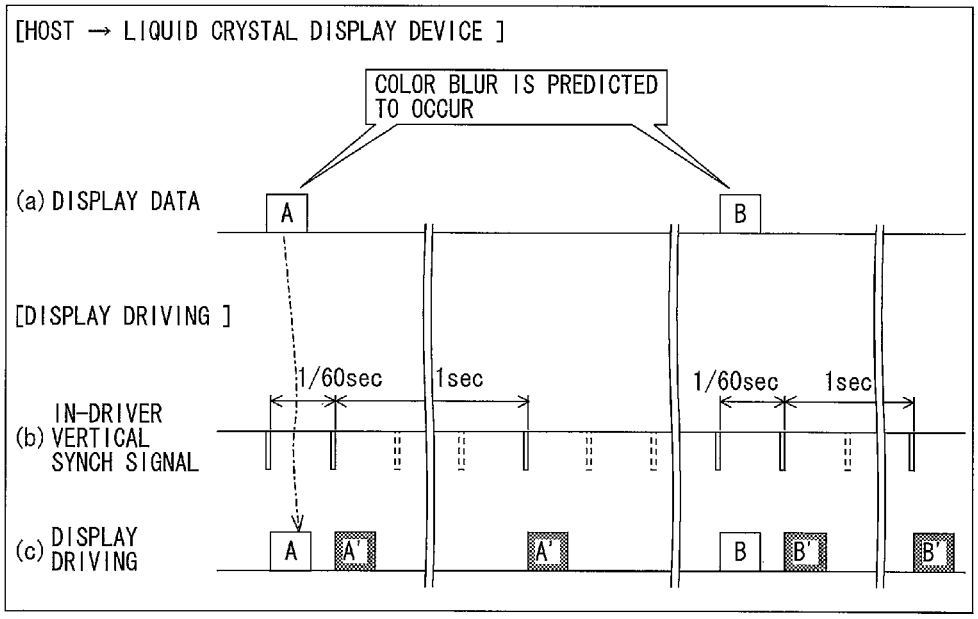
FIG. 13 is a timing chart illustrating how a liquid crystal display device in accordance with Embodiment 5 of the present invention displays an image in a case where a color blur is predicted to occur.

FIG. 13 is a timing chart illustrating how the liquid crystal display device 6 displays an image in a case where a color blur is predicted to occur. FIG. 13 illustrates a case where a still image A and a still image B are alternately displayed. The host control section 31 transfers display data (image A) of one frame to the liquid crystal display device 6 only when content of the display image is changed (see (a) of FIG. 13). After the display data on the image A has been transferred, it is when the content of the display image is rewritten to be another image that the host control section 31 transfers display data to the liquid crystal display device 6 next. It is assumed that the color blur is predicted to occur during a period in which the image A and the image B are displayed.

With a timing synchronized with an in-driver vertical synch signal illustrated in (b) of FIG. 13, the displayed image on the display section 10 is rewritten by the display control section 15 so to be the image A (see (c) of FIG. 3). The image A is based on display data in which the first process has not been carried out. Then, the display control section 15 displays, 1/60 second after the image A has been displayed, an image A' in which the first process has been carried out. Then, the display control section 15 refreshes, at every second, the image A' in which the first process has been carried.

In a case where the display image is changed to the image B, the display control section 15 likewise (i) displays, in a frame in which the display image changes, the image B in which the first process has not been carried out and (ii) displays, in a frame in which the display image does not change, image B' in which the first process has been carried out.

Note that the image A can be displayed a plurality of times. Then, the image A', which is rewritten at 60 Hz, can also be displayed a plurality of times. In the frame in which the display image changes, the image A is displayed. Then, the image A', in which the first process has been carried out, is displayed (written into pixels) at least once at the first intervals. Then, the image A', in which the first process has been carried out, is refreshed at the second intervals each of which is longer than the first interval. This allows for a reduction in the number of times refreshing is carried out during a period in which the display image does not change.

Figure 14:
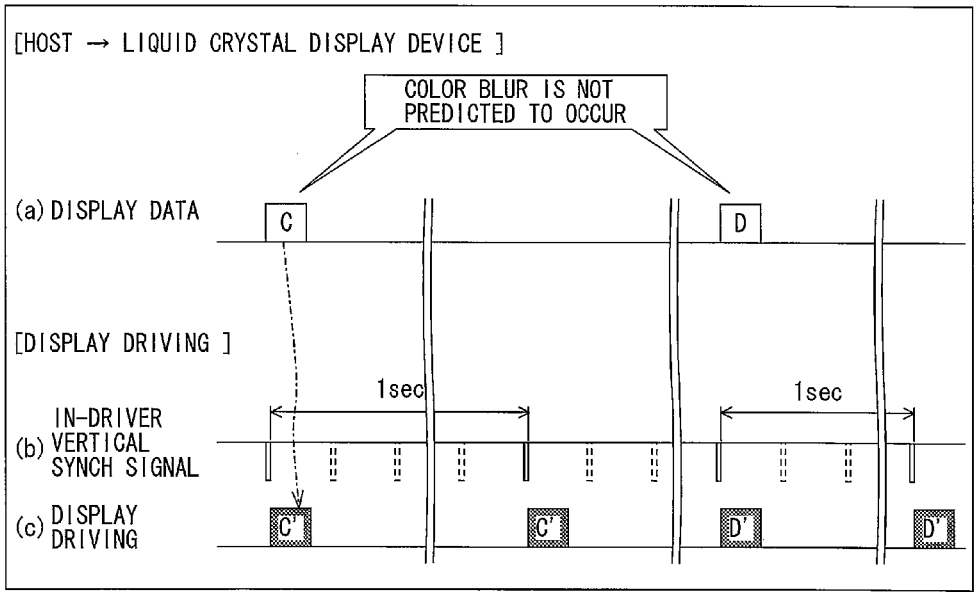
FIG. 14 is a timing chart illustrating how the liquid crystal display device in accordance with Embodiment 5 of the present invention displays an image in a case where a color blur is not predicted to occur.

FIG. 14 is a timing chart illustrating how the liquid crystal display device 6 displays an image in the case where a color blur is not predicted to occur. FIG. 14 illustrates a case where a still image C and a still image D are alternately displayed. In the case where the color blur is not predicted to occur, image C', in which the first process has been carried out, is displayed in the frame in which a display image changes. Then, the image C', in which the first process has been carried out, is refreshed every second. The image D is processed as is the case of the image C. Note that the image C' can be (i) refreshed 1/60 Hz after the frame (first image C') in which the display image changes and then (ii) refreshed every second.

According to Embodiment 5, in a case where a color blur is predicted to occur, a display image, in which the first process has not been carried out, is displayed in a frame in which a display image changes, so that the color blur is prevented from occurring. Then, the display image is rewritten, at first intervals each of which is short, as a display image in which the first process has been carried out. This allows a display image, in which color component adjustment has been carried out, to be displayed, and therefore allows a display quality to be maintained. It is also possible to refresh subsequent display images at second intervals each of which is longer than the first interval. In particular, according to the display section 10 for which an oxide semiconductor is used, it is possible to maintain a display quality even in a case where a refresh rate is reduced to approximately 1 Hz. This allows for a reduction in the number of refreshing, and therefore allows for a reduction in electric power consumption.

SUMMARY

A display device (liquid crystal display device 1) in accordance with Aspect 1 of the present invention is configured to include picture elements each including a plurality of pixels of respective color components, said display device including: an adjustment setting section (11) for setting whether or not color component adjustment is to be carried out; a color component adjusting section (14) for selectively carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element; a background color setting section (12) for selectively carrying out, in a case where a character in an achromatic color is displayed against a substantially black background, a second process of setting, as a background color, a color in which the grayscale level of the second color component is higher than the grayscale level of the first color component; and an image generating section (display image generating section 13) for generating, with use of the background color, the input data indicative of a display image, in a case where the color component adjustment is set to be carried out, (i) the background color setting section carrying out the second process and (ii) the color component adjusting section carrying out the first process, and in a case where the color component adjustment is set not to be carried out, (i) the background color setting section not carrying out the second process and (ii) the color component adjusting section not carrying out the first process.

According to the configuration, the first color component of the input data and the second color component of the input data are subjected to respective grayscale level conversions (first process). This allows the picture element to be displayed in a chromatic color. The grayscale level of the second color component in the background color is set to be higher than the grayscale level of the first color component in the background color (second process). This makes it possible to cause a difference in response speed between pixels of the first color component and pixels of the second color component to be small. Therefore, it is possible to prevent a color blur from occurring to the character in an achromatic color when the display image changes.

The display device in accordance with Aspect 2 of the present invention can be configured in Aspect 1 such that: in the first process, the color component adjusting section makes the conversion so as to cause the grayscale level of the second color component of the picture element after the conversion to be lower than the grayscale level of the first color component of the picture element after the conversion by a first adjustment amount; and in the second process, the background color setting section sets the grayscale level of the second color component in the background color to be higher than the grayscale level of the first color component in the background color by a second adjustment amount corresponding to the first adjustment amount.

The display device in accordance with Aspect 3 of the present invention can be configured in Aspect 1 or 2 such that a difference between the grayscale level of the first color component in the background color and the grayscale level of the second color component in the background color is 20% or less of an entire grayscale level range.

The display device in accordance with Aspect 4 of the present invention can be configured in any one of Aspects 1 through 3 such that: the adjustment setting section is set so that the color component adjustment is carried out in a case where the picture element is displayed in a chromatic color under a condition causing the first process not to be carried out; and the adjustment setting section is set so that the color component adjustment is not carried out in a case where the picture element is displayed in an achromatic color under a condition causing the first process not to be carried out.

A display device in accordance with Aspect 5 of the present invention is configured to include picture elements each including a plurality of pixels of respective color components, said display device including: a color component adjusting section for carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element; and a predicting section (21) for predicting an occurrence of a color blur occurring as a result of a change in a display image, in a case where an occurrence of a color blur is predicted, the color component adjusting section not subjecting at least part of the display image to the first process.

According to the configuration, prediction of the color blur has been carried out, and in the case where the color blur is predicted to occur, the first process of subjecting the first color component of the input data and the second color component of the input data to respective grayscale level conversions is not carried out. This makes it possible to cause a difference in response speed between pixels of the first color component and pixels of the second color component to be small. Therefore, it is possible to prevent a color blur from occurring.

A display device in accordance with Aspect 6 of the present invention can be configured in Aspect 5 to further include a region specifying section (22) for specifying, in the case where the occurrence of the color blur is predicted, (i) a changeable region in which a change in a corresponding part of the display image occurs and (ii) an unchangeable region in which a change in a corresponding part of the display image does not occur, in the case where the occurrence of the color blur is predicted, the color component adjusting section subjecting the unchangeable region to the first process while not subjecting the changeable region to the first process.

The display device in accordance with Aspect 7 of the present invention can be configured in Aspect 5 such that, in the case where the occurrence of the color blur is predicted, the color component adjusting section does not subject, to the first process, a picture element of a specific color made by a specific combination of the grayscale levels of the respective color components.

The display device in accordance with Aspect 8 of the present invention can be configured in Aspect 7 such that the specific color is an achromatic color.

A display device in accordance with Aspect 9 of the present invention can be configured in Aspect 7 or 8 to further include a specific color setting section (24) for setting, as the specific color, a color used as a character color in the display image.

A display device in accordance with Aspect 10 of the present invention can be configured in Aspect 5 such that, in the case where the occurrence of the color blur is predicted, the color component adjusting section does not carry out the first process in a frame in which a change in the display image occurs.

The display device in accordance with Aspect 11 of the present invention can be configured in Aspect 10 to further include a display control section (15), the color component adjusting section carrying out the first process in a frame in which the change in the display image does not occur, and the display control section (i) displaying, in the frame in which the change in the display image occurs, a first display image in which the first process has not been carried out, (ii) a first interval after the first display image has been displayed, displaying, at least once, a second display image in which the first process has been carried out, and then (iii) refreshing the second display image at second intervals each of which is longer than the first interval.

The display device in accordance with Aspect 12 of the present invention can be configured in any one of Aspects 5 through 11 such that the predicting section predicts an occurrence of a color blur in a case where the predicting section detects the change in the display image.

The display device in accordance with Aspect 13 of the present invention can be configured in any one of Aspects 5 through 11 such that the predicting section predicts an occurrence of a color blur in a case where the predicting section detects the change in the display image.

The display device in accordance with Aspect 14 of the present invention can be configured in Aspect 13 such that the predicting section detects the change in the display image in accordance with (i) a user's operation on a host device from which data of the display image is supplied to the display device or (ii) reproduction of a moving image by the host device.

The display device in accordance with Aspect 15 of the present invention can be configured in any one of Aspects 5 through 11 such that the predicting section predicts an occurrence of a color blur in a case where a contrast of the display image is higher than a predetermined reference value.

A user device (3) in accordance with Aspect 16 of the present invention includes display device as set forth in any one of Aspects 5 through 11, the user device can be configured to serve as a host device so as to cause the display device to display a display image.

A display device adjusting method in accordance with Aspect 17 of the present invention is a method of adjusting a display device, said display device (i) being configured to generate, with use of a set background color, input data indicative of a display image and (ii) including picture elements each including a plurality of pixels of respective color components, said method including: an inspecting step of inspecting whether or not the display device displays a picture element in an achromatic color, the picture element being a picture element in which grayscale levels of respective color components of the input data are equal; a first setting step of setting, in a case where the picture element is determined in the inspecting step to be displayed not in the achromatic color but in a chromatic color which is colored with a second color component, the display device such that the display device carries out a first process of generating output data by making a conversion of a grayscale level of each of pixels of the input data so that the picture element is displayed in the achromatic color, the conversion causing a grayscale level of a second color component of the picture element to be lower than a grayscale level of a first color component of the picture element; and a second setting step of setting, in a case where the display device displays a character in the achromatic color against a substantially black background, the display device such that the display device carries out a second process for setting, as the background color, a color in which the grayscale level of the second color component is higher than the grayscale level of the first color component.

A display device controlling method in accordance with Aspect 18 of the present invention is configured such that a display device to be controlled includes picture elements each including a plurality of pixels of respective color components, said method including: a predicting step of predicting an occurrence of a color blur occurring as a result of a change in a display image; and a color component adjusting step of carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element, in a case where the occurrence of the color blur is predicted, at least part of the display image is not subjected to the first process in the color component adjusting step.

The explanations in the above embodiments are made under the condition that the liquid crystal display device is employed as the display device. However, the present invention can be applied not only to the liquid crystal display device, but also to a display device in which a response speed of pixels varies depending on grayscale levels of display data.

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention is applicable to (i) display devices, (ii) user devices, (iii) methods of adjusting the display devices, and (iv) methods of controlling the display devices.

REFERENCE SIGNS LIST

1 Liquid crystal display device (display device)
3 User device
11 Adjustment setting section
12 Background color setting section
13 Display image generating section (image generating section)
14 Color component adjusting section
15 Display control section
21 Predicting section
22 Region specifying section
24 Specific color setting section

The invention claimed is:

1. A display device including picture elements each including a plurality of pixels of respective color components, said display device comprising:

an adjustment setting section for setting whether or not color component adjustment is to be carried out;

a color component adjusting section for selectively carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element;

a background color setting section for selectively carrying out, in a case where a character in an achromatic color is displayed against a substantially black background, a second process of setting, as a background color, a color in which the grayscale level of the second color component is higher than the grayscale level of the first color component; and an image generating section for generating, with use of the background color, the input data indicative of a display image, in a case where the color component adjustment is set to be carried out, (i) the background color setting section carrying out the second process and (ii) the color component adjusting section carrying out the first process, and in a case where the color component adjustment is set not to be carried out, (i) the background color setting section not carrying out the second process and (ii) the color component adjusting section not carrying out the first process.

2. The display device as set forth in claim 1, wherein:

in the first process, the color component adjusting section makes the conversion so as to cause the grayscale level of the second color component of the picture element after the conversion to be lower than the grayscale level of the first color component of the picture element after the conversion by a first adjustment amount; and in the second process, the background color setting section sets the grayscale level of the second color component in the background color to be higher than the grayscale level of the first color component in the background color by a second adjustment amount corresponding to the first adjustment amount.

3. The display device as set forth in claim 1, wherein a difference between the grayscale level of the first color component in the background color and the grayscale level of the second color component in the background color is 20% or less of an entire grayscale level range.

4. The display device as set forth in claim 1, wherein:

the adjustment setting section is set so that the color component adjustment is carried out in a case where the picture element is displayed in a chromatic color under a condition causing the first process not to be carried out; and the adjustment setting section is set so that the color component adjustment is not carried out in a case where the picture element is displayed in an achromatic color under a condition causing the first process not to be carried out.

5. A user device comprising:

a display device as set forth in claim 1, the user device being configured to serve as a host device so as to cause the display device to display a display image.

6. A display device including picture elements each including a plurality of pixels of respective color components, said display device comprising:

a color component adjusting section for carrying out a first process of generating output data by making a conversion of a grayscale level of each of pixels of input data so that a picture element is displayed in an achromatic color, the picture element being a picture element in which grayscale levels of respective color components of the input data are equal, and the conversion causing a grayscale level of a second color component of the picture element to be lower than a grayscale level of a first color component of the picture element; and a predicting section for predicting an occurrence of a color blur occurring as a result of a change in a display image, in a case where an occurrence of a color blur is predicted, the color component adjusting section not subjecting at least part of the display image to the first process.

7. A display device as set forth in claim 6, further comprising:

a region specifying section for specifying, in the case where the occurrence of the color blur is predicted, (i) a changeable region in which a change in a corresponding part of the display image occurs and (ii) an unchangeable region in which a change in a corresponding part of the display image does not occur, in the case where the occurrence of the color blur is predicted, the color component adjusting section subjecting the unchangeable region to the first process while not subjecting the changeable region to the first process.

8. The display device as set forth in claim 6, wherein, in the case where the occurrence of the color blur is predicted, the color component adjusting section does not subject, to the first process, a picture element of a specific color made by a specific combination of the grayscale levels of the respective color components.

9. The display device as set forth in claim 8, wherein the specific color is an achromatic color.

10. A display device as set forth claim 8, further comprising:

a specific color setting section for setting, as the specific color, a color used as a character color in the display image.

11. The display device as set forth in claim 6, wherein, in the case where the occurrence of the color blur is predicted, the color component adjusting section does not carry out the first process in a frame in which a change in the display image occurs.

12. A display device as set forth in claim 11, further comprising:

a display control section, the color component adjusting section carrying out the first process in a frame in which the change in the display image does not occur, and the display control section (i) displaying, in the frame in which the change in the display image occurs, a first display image in which the first process has not been carried out, (ii) a first interval after the first display image has been displayed, displaying, at least once, a second display image in which the first process has been carried out, and then (iii) refreshing the second display image at second intervals each of which is longer than the first interval.

13. The display device as set forth in claim 6, wherein the predicting section predicts an occurrence of a color blur in a case where the predicting section detects that a specific application is running in a host device from which data of the display image is supplied to the display device.

14. The display device as set forth in claim 6, wherein the predicting section predicts an occurrence of a color blur in a case where the predicting section detects the change in the display image.

15. The display device as set forth in claim 14, wherein the predicting section detects the change in the display image in accordance with (i) a user's operation on a host device from which data of the display image is supplied to the display device or (ii) reproduction of a moving image by the host device.

16. The display device as set forth in claim 6, wherein the predicting section predicts an occurrence of a color blur in a case where a contrast of the display image is higher than a predetermined reference value.

17. A user device comprising:

a display device as set forth in claim 6, the user device being configured to serve as a host device so as to cause the display device to display a display image.

18. A method of adjusting a display device, said display device (i) being configured to generate, with use of a set background color, input data indicative of a display image and (ii) including picture elements each including a plurality of pixels of respective color components, said method comprising:

an inspecting step of inspecting whether or not the display device displays a picture element in an achromatic color, the picture element being a picture element in which grayscale levels of respective color components of the input data are equal;

a first setting step of setting, in a case where the picture element is determined in the inspecting step to be displayed not in the achromatic color but in a chromatic color which is colored with a second color component, the display device such that the display device carries out a first process of generating output data by making a conversion of a grayscale level of each of pixels of the input data so that the picture element is displayed in the achromatic color, the conversion causing a grayscale level of a second color component of the picture element to be lower than a grayscale level of a first color component of the picture element; and a second setting step of setting, in a case where the display device displays a character in the achromatic color against a substantially black background, the display device such that the display device carries out a second process for setting, as the background color, a color in which the grayscale level of the second color component is higher than the grayscale level of the first color component.

* * * * *